US006672239B1

(12) United States Patent
Gieseke

(10) Patent No.: US 6,672,239 B1
(45) Date of Patent: Jan. 6, 2004

(54) ELASTOMERIC LAUNCH ASSEMBLY AND METHOD OF LAUNCH

(75) Inventor: Thomas J. Gieseke, Newport, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/267,091

(22) Filed: Oct. 8, 2002

(51) Int. Cl.[7] ..... B63G 8/32

(52) U.S. Cl. ..... 114/316; 114/238; 124/16; 124/17

(58) Field of Search ..... 114/316, 318, 114/238, 239; 89/1.809; 124/16, 17

(56) References Cited

U.S. PATENT DOCUMENTS 5,671,722 A * 9/1997 Moody ..... 124/22

6,354,182 B1 * 3/2002 Milanovich ..... 89/1.818

* cited by examiner

*Primary Examiner*—Sherman Basinger
(74) *Attorney, Agent, or Firm*—James M. Kasischke; Michael F. Oglo; Jean-Paul A. Nasser

(57) ABSTRACT

A launch assembly having an elastomeric tube for launching a device is disclosed. To launch the device an outboard end of the tube is movable outwardly along the length of a housing by an extending device, while the inboard end of the tube is restrained by a release mechanism and remains stationary. Thus, as the outboard end moves and the inboard end remains stationary, the elastomeric tube elongates. The tube may be elongated a predetermined amount, at which time the inboard end of the tube is released by the release mechanism. Releasing the inboard end allows it to travel toward the now stationary outboard end with a sufficient velocity to launch the device. The amount of elongation of the tube is related to the amount of possible launch energy. Thus, greater elongation of the tube provides a greater launch velocity, while shorter elongation provides a reduced launch velocity, as desired.

19 Claims, 4 Drawing Sheets

ELASTOMERIC LAUNCH ASSEMBLY AND METHOD OF LAUNCH

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of Invention

The present invention relates to an elastomeric launch assembly for expelling a device from a vehicle, and more particularly to an elastomeric launch assembly which is operationally insensitive to ambient pressure and which can launch the device, such as a counter measure, defensive weapon, or an offensive weapon with variable energy.

(2) Description of the Prior Art

It is well known that submarines must be capable of delivering countermeasures, defensive weapons, offensive weapons, and other devices from externally stowed modules or tubes, in order to defend themselves against attacking torpedoes and other threats. Conventional launch assemblies utilize chemical gas generators in order to force the devices from their launch tubes. Because conventional launch assemblies rely upon pressure developed at the base of the devices inside of the launch tubes, they are sensitive to ambient pressure. At depths of greater than about several hundred feet the ambient pressure can often prevent the launched devices from achieving acceptable launch velocities.

In addition to being sensitive to ambient pressures, current gas generator based systems are not operated over a range of energy levels. Instead, these generators are ignited and burn at a predetermined rate, thus forcing the device from its launch tube at a fixed velocity. When stealth operation is a priority, conventional launch assemblies cannot be adjusted to provide a low impulse, or "quiet" launch.

Another issue associated with conventional launch assemblies is that the handling of their combustible or explosive gas generators represents a significant cost. To safely handle the combustible or explosive gas generators requires an investment in time, money and training.

Accordingly, there is needed in the art a launch assembly which is capable of performing at various ambient pressures, which preferably can be operated in a range of launch energy modes, and which is safe and reliable during operation.

SUMMARY OF THE INVENTION

The present invention is directed to a launch assembly having an elastomeric tube designed to at least partially receive the body of the device to be launched. Before launch, the tube is secured to a support housing having an inboard end and an outboard end. To launch the device, an outboard end of the elastomeric tube is movable outwardly along the length of the housing by an extending device. In one embodiment, the extending device includes a ring attached to both the outboard end of the tube and to at least a pair of rails which run along the length of the housing, from the inboard end to the outboard end. The rails may preferably be threaded, and the ring may be attached thereto by nuts and linear bearings, which are preferably disposed around the periphery of the ring and matingly engage the threaded rails in one embodiment. A motor may be provided to turn the screws which, when turned, operate to force the nuts attached to the outboard end of the ring to move the ring toward the outboard end of the support housing.

As the attached ring and outboard end of the elastomeric tube moves, the inboard end of the tube is restrained by a release mechanism and remains stationary. Thus, as the outboard end moves outwardly and the inboard end remains stationary, the elastomeric tube becomes elongated. The tube may be elongated a predetermined amount, at which time the inboard end of the elastomeric tube is released from the base assembly by the release mechanism. In one embodiment, the release mechanism includes a hook releasably engaged with a plate supported on the inboard end of the tube. To release the inboard end of the tube, the hook is rotated from engagement with the plate. Releasing the inboard end allows it to travel toward the now stationary outboard end with a sufficient velocity to launch the device housed within the tube. As will be appreciated, the amount of elongation of the tube is related to the amount of possible launch energy. Thus, greater elongation of the tube provides a greater launch velocity, while shorter elongation provides a reduced launch velocity, as desired.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DESCRIPTION OF THE PREFERRED EMBODIMENTS

Figure 1:
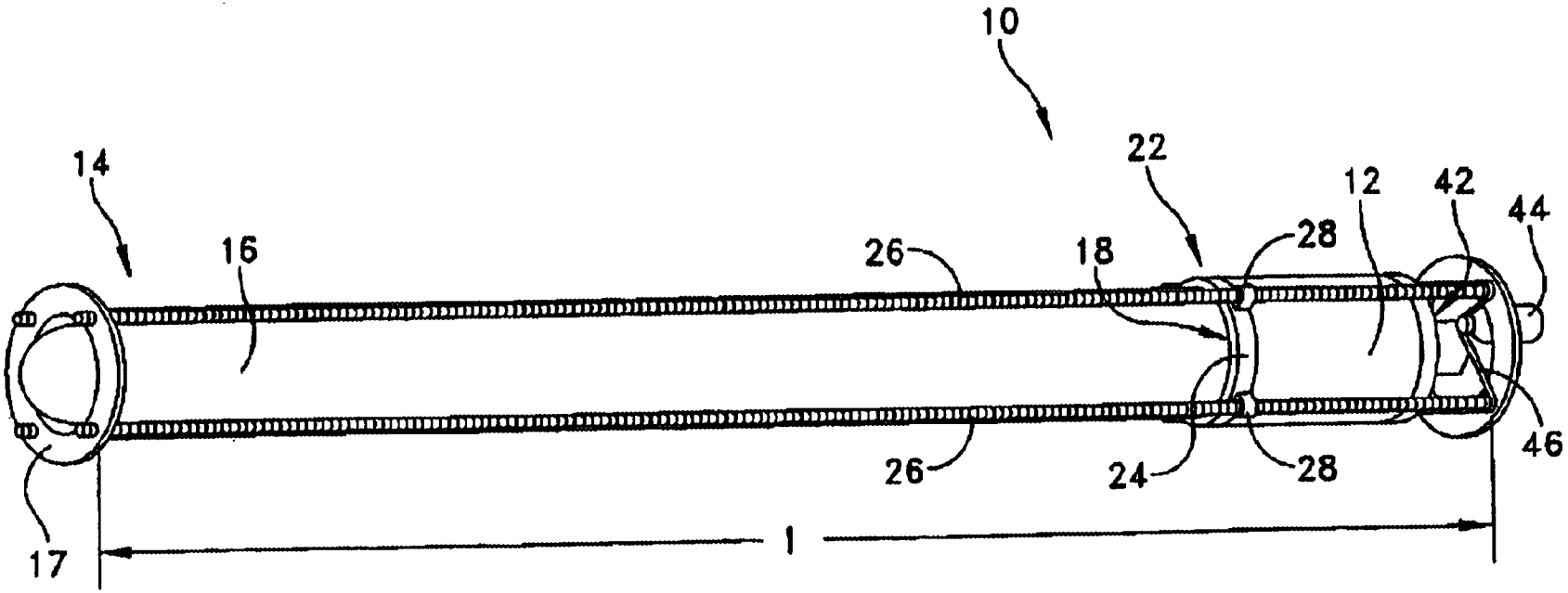
FIG. 1 is a perspective view of the elastomeric launch assembly according to the present invention.

Referring now to the FIGS., launch assembly 10 includes an elastomeric tube 12 which is movable along a length of a launch housing 14 in order to launch a device 16 underwater. Launch housing 14 is fixed to the hull of the launching vehicle. The launch housing preferably includes at least a pair of rails 26 supported at either end by an outboard ring 17 and an inboard ring 38. The elastomeric tube 12 is positioned around at least one end of the device 16 to be launched, is stretchable in at least a longitudinal direction along a length, "l", of the housing, and acts as an energy storage device. The tube 12 is preferably of a size and shape sufficient to receive at least a portion of the one end of the device 16 to be launched, which may have any of a variety of sizes in terms of both length and diameter, as desired. The tube may be made of any suitable elastomeric material, for example natural or artificial rubber, and preferably includes an open, outboard end 18, a closed, inboard end 20, and is supported by the launch housing 14. In the present embodiment, the outboard end 18 of the elastomeric tube 12 is movable along the length of the launch housing 14 by an extending device 22. The extending device 22 may include a movable ring 24 operatively connected to both the outboard end 18 of the tube 12 and to at least the pair of rails 26. Preferably, the rails 26 are threaded, with the ring 24 being operatively engaged therewith by at least a pair of corresponding threaded nuts 28 and linear bearings (not shown), which may be spaced around the periphery of the ring 24 and which matingly engage the threaded rails 26 in the present embodiment. The movable ring 24 may be attached to the elastomeric tube in any manner suitable to withstand the operating forces and undersea operation, for example, by clamping, surface bonding, or another manner as would be known to those of skill in the art. Likewise, the ring 24 is preferably made of a material sufficient to withstand the operating forces during the launch mode, and may be coated for underwater operation. Any of a number of suitable metals, or other materials, may be utilized as would be known to those of skill in the art. The extending device can also include other components, and may not include a ring, provided that the outboard end receives the device to be launched, and remains movable along a length of the housing.

The inboard end 20 of the elastomeric tube 12 is preferably closed so as to provide an attachment point for the tube release mechanism 30. As best shown in FIGS. 3–6, the tube may be closed by a plate 32 which provides support for the release mechanism 30. During use, one end of the device 16 to be launched may also rest on the interior surface of the plate 32. The plate 32 may be attached to the inboard end 20 of the elastomeric tube in any manner suitable to withstand the operating forces and undersea operation, for example, by clamping, surface bonding, or another manner as would be known to those of skill in the art. The release mechanism preferably includes a hook 34 which is releasably connected to a coupling or link 36. In the present embodiment, the link 36 may be supported on an outer surface of plate 32, while the hook may be supported by the inboard ring 38. The hook is preferably pivotally supported and includes a first end which is releasably engagable with the link 36, and a second end which is operatively connected to a driver, such as piston 40. In use, the piston 40 operates to move the hook from an engaged, or locked position, to a non-engaged, or release position, as described in greater detail below. Alternate release mechanism may also be utilized, or the exemplary release mechanism may be modified, for example the hook may be positioned on the plate 32, and the link 36 on the inboard ring 38, as would be known to those of skill in the art. In any case, the release mechanism should provide sufficient strength and durability to restrain the inboard end of the tube in order to prevent the tube 12 from contracting as the outboard end 18 of the tube is elongated, prior to launch.

Figure 2:
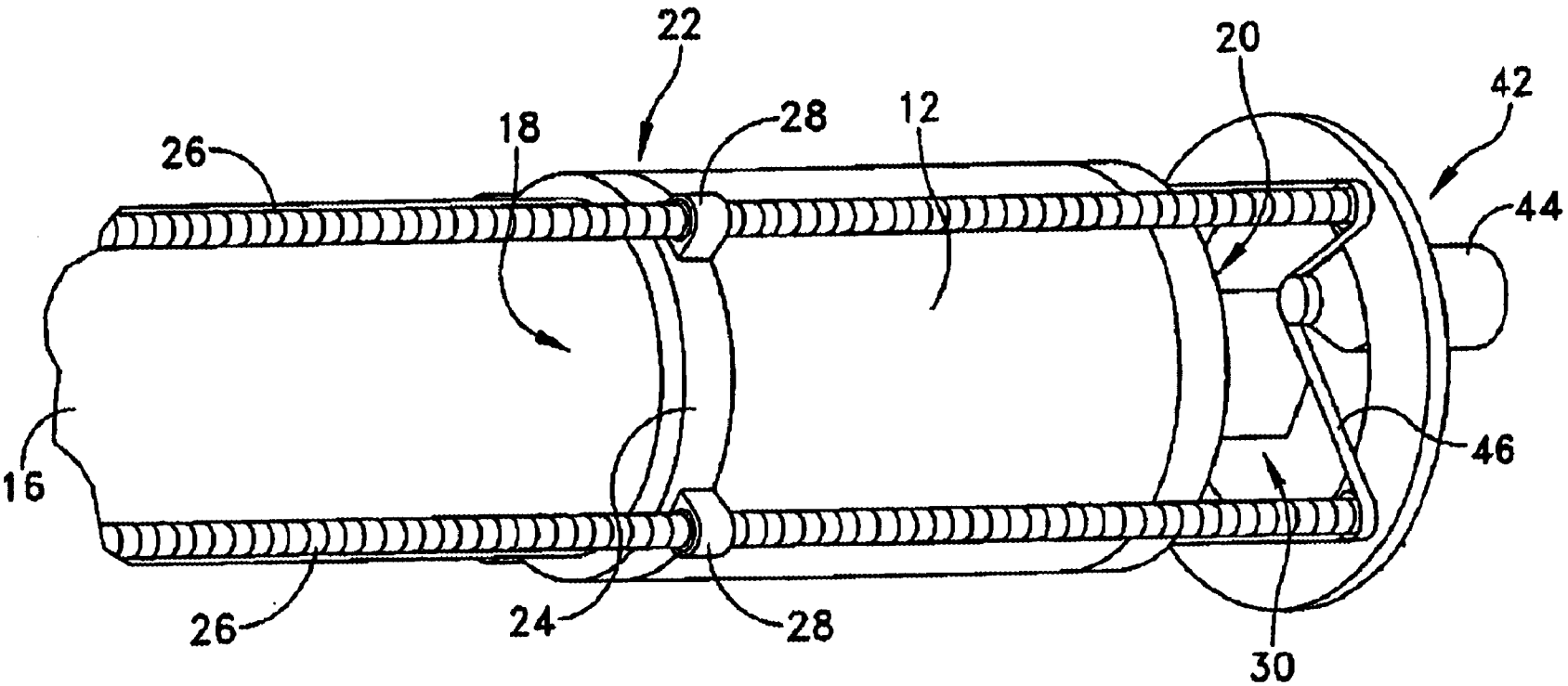
FIG. 2 is an enlarged perspective view of the inboard end of the elastomeric launch assembly of FIG. 1.
Figure 3:
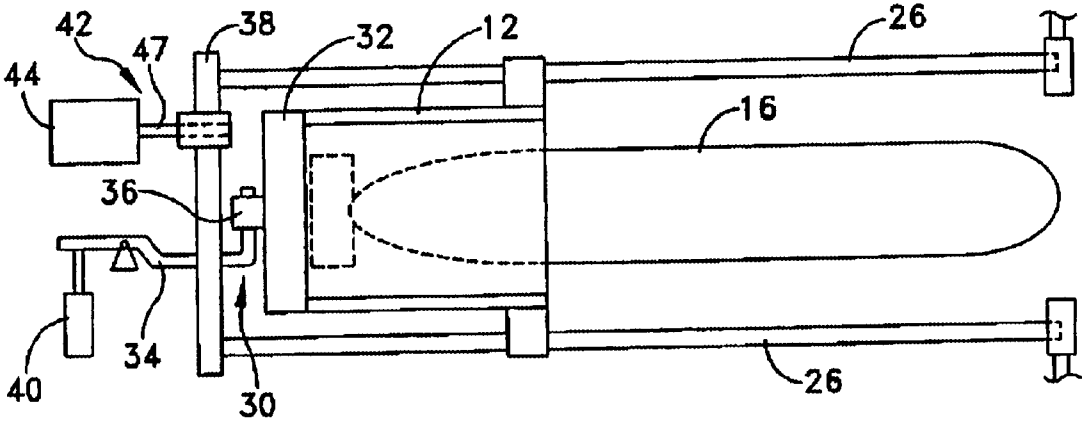
FIG. 3 is a top, schematic view of the elastomeric launch assembly of FIG. 1 in an initial, or non-engaged position.
Figure 4:
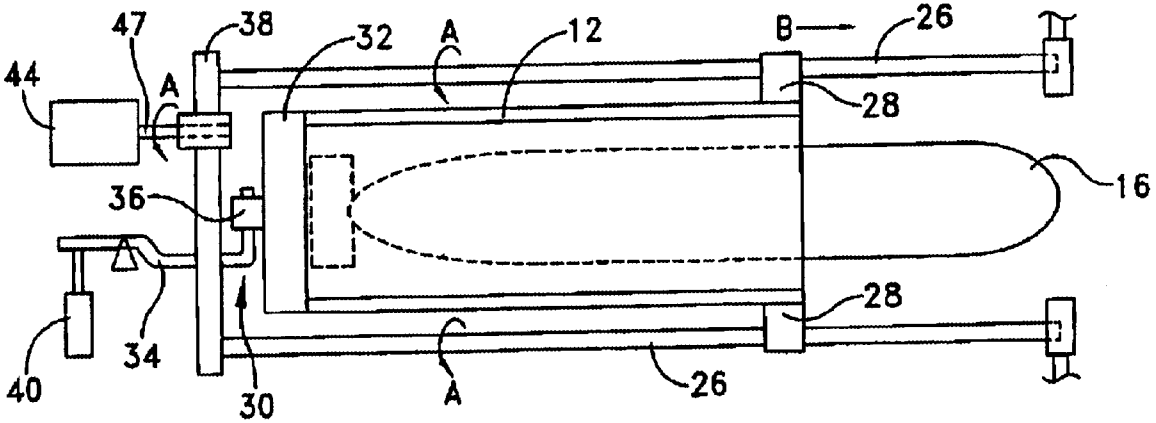
FIG. 4 is a top, schematic view of the elastomeric launch assembly of FIG. 1 during engagement.

In order to rotate the rails 26 and move the outboard end of the elastomeric tube 12, a drive assembly 42 is also preferably provided. The drive assembly 42 may include a motor 44 which is operatively connected to the rails 26 in order to rotate the rails, as described below. The motor 44 may be of any design and speed. However, since the rate at which the motor 44 is capable of rotating the rails 26 to elongate the elastomeric tube 12 will effect the launch rate of the device, the motor 44 should provide sufficient power for the given device and operating conditions. The drive assembly 42 also preferably includes a drive belt or chain 46 (FIGS. 1 and 2) which is operatively connected to both the motor 44 and the rails 26, such that as the motor runs the belt or chain is moved which, in turn, rotates the rails 26. In the present embodiment, a chain and sprocket assembly is preferably provided, although alternate devices may be utilized, as would be known to those of skill in the art.

Use of the launch assembly 10 will now be described with reference to FIGS. 3–6.

Figure 5:
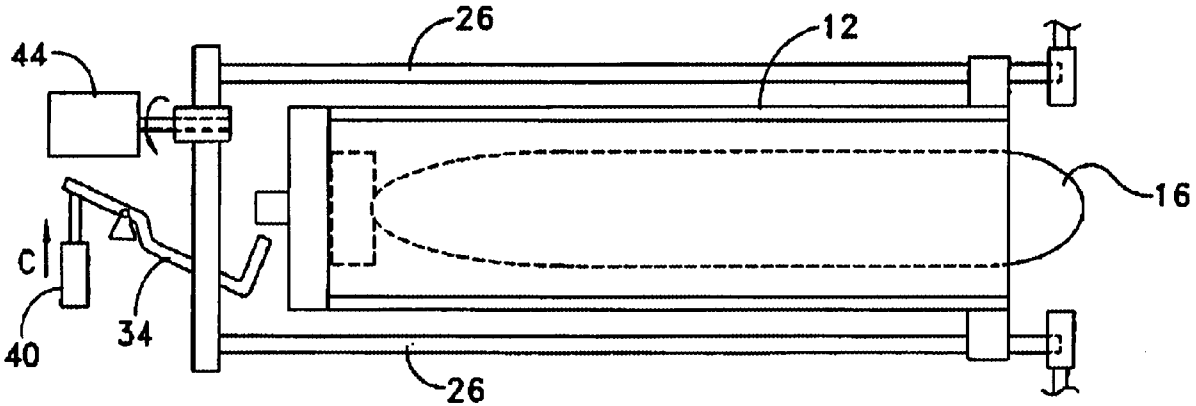
FIG. 5 is a top, schematic view of the elastomeric launch assembly of FIG. 1 during release of the elastomeric tube.
Figure 6:
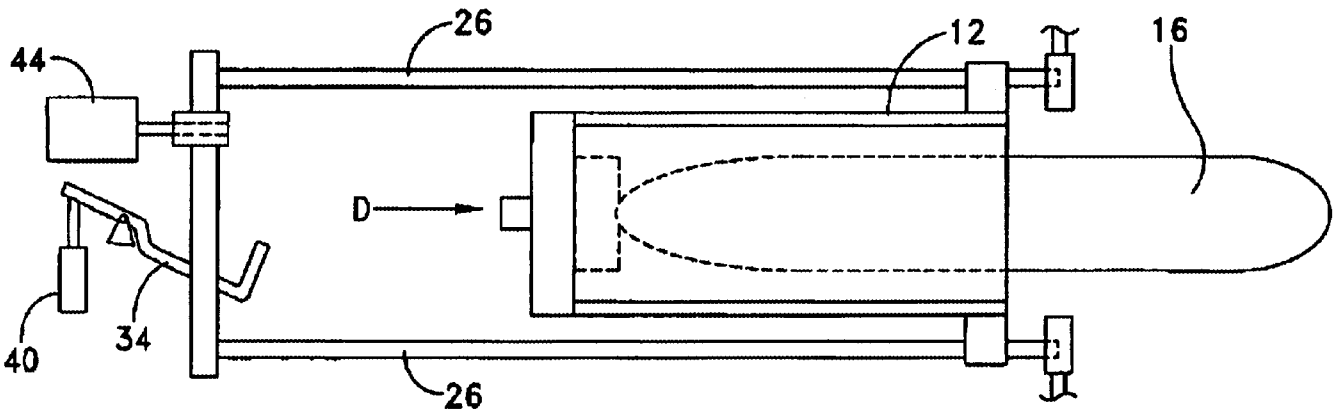
FIG. 6 is a top, schematic view of the elastomeric launch assembly of FIG. 1 launching a countermeasure or other device.

In an initial, or non-engaged position (FIG. 3), a first end of the device 16 to be launched is supported within the elastomeric tube 12. In the initial position, the tube is at rest, i.e., is not elongated, such that no energy is stored within the tube in this position. The motor 44, rails 26 and ring 24 remain stationary in the non-engaged position. As the command is received to prepare for launch, the launch assembly moves into the engaged position (FIG. 4), wherein the motor begins to operate to turn a shaft 47 (arrow "A") which is operatively connected to the drive chain 46, the chain being operatively connected to the rails 26. As the rails 26 begin to rotate in the direction of arrow A, they matingly engage the nuts 28 attached to ring 24 such that the ring begins to move outwardly toward the outboard end of the assembly, as shown by arrow "B". As the ring 24 moves, the elastomeric tube 12 which is restrained at its inboard end 20 begins to elongate, or extend at the outboard end 18, along the length of the housing, thereby storing potential energy. Once the outboard end of the tube 12 is moved a distance determined to be sufficient to provide the requisite energy to launch the device at a desired speed or distance, as determined by the particular device to be launched and launch conditions, rotation of the rails is stopped. The outboard end 18 of the tube is now stationary, and the inboard end 20 of the tube is then released, as shown in FIG. 5. In the present embodiment, to release the inboard end the piston 40 moves in the direction of arrow "C" to rotate the hook 34 from engagement with the link 36 supported on the inboard end of the tube. Once the inboard end 20 is released, the tube contracts, i.e., the inboard end moves within the housing 14 in the direction of arrow "D", toward the outboard end of the assembly. This causes the device within the tube to accelerate until it is fired from the launch assembly (FIG. 6). As will be appreciated, the launch assembly of the present invention is capable of performing at various ambient pressures, can be operated in a range of launch energy modes by varying the elongation of the tube, and is safe and reliable during operation since no combustible components are utilized.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A launch assembly for launching a device from an underwater vehicle comprising:

a housing;

an elastomeric tube supported by the housing and having an inboard end and an outboard end, and constructed and dimensioned to receive an inboard end of the device to be launched;

an extending device supported on the outboard end of the tube and constructed and arranged to move along a length of the housing;

a drive assembly operatively engaged with the housing to move the extending device along the length of the housing; and a release mechanism constructed and arranged to restrain and releasably engage the inboard end of the tube, wherein moving the extending device along the length of the housing causes the outboard end of the tube to move in an outboard direction, as the inboard end of the tube is restrained by the release mechanism such that the tube becomes elongated, and wherein to launch the device the inboard end of the tube is released by the release mechanism such that the inboard end of the tube moves toward the outboard end of the tube, and the tube contracts thus accelerating the device within the tube and launching the device from within the tube.

2. The launch assembly of claim 1 wherein the housing includes at least a pair of threaded rails supported at either end by an outboard ring and an inboard ring.

3. The launch assembly of claim 2 wherein the extending device includes a movable ring operatively connected to both the outboard end of the tube and to the threaded rails.

4. The launch assembly of claim 3 wherein the movable ring is operatively connected to the threaded rails by at least a pair of threaded nuts which are supported on the movable ring and which matingly engage the threaded rails.

5. The launch assembly of claim 4 wherein the drive assembly includes a motor operatively connected to the threaded rails to provide rotation of the threaded rails during use.

6. The launch assembly of claim 5 wherein the drive assembly further comprises:

a shaft joined to the motor; and a drive belt connected between the shaft and the threaded rails.

7. The launch assembly of claim 1 wherein the inboard end of the tube is closed by a plate which is constructed and arranged to provide support to the release mechanism.

8. The launch assembly of claim 7 wherein the release mechanism preferably includes:

a link supported on the outer surface of the plate; and a hook pivotally supported on the housing and releasably connected to the link.

9. The launch assembly of claim 8 further comprising a driver constructed and arranged to pivot the hook from engagement with the link in order to release the inboard end of the tube in order to launch the device.

10. A launch assembly for launching a device from an underwater vehicle comprising:

a housing including at least a pair of threaded rails supported at either end by an outboard ring and an inboard ring;

an elastomeric tube supported by the housing and having a closed inboard end and an open outboard end, and constructed and dimensioned to receive at least an inboard end of the device to be launched;

an extending device including a movable ring operatively connected to both the outboard end of the tube and to the threaded rails, the extending device being constructed and arranged to move along a length of the housing;

a drive assembly operatively engaged with the housing to move the extending device along the length of the housing;

a release mechanism constructed and arranged to restrain and releasably engage the inboard end of the tube; and wherein moving the extending device along the length of the housing causes the outboard end of the tube to move in an outboard direction, as the inboard end of the tube is restrained by the release mechanism such that the tube becomes elongated, and wherein to launch the device the inboard end of the tube is released by the release mechanism such that the inboard end of the tube moves toward the outboard end of the tube, and the tube contracts thus accelerating the device within the tube and launching the device from within the tube.

11. The launch assembly of claim 10 wherein the movable ring is operatively connected to the threaded rails by at least a pair of threaded nuts which are supported on the movable ring and which matingly engage the threaded rails.

12. The launch assembly of claim 10 wherein the release mechanism preferably includes:

a link supported on the outer surface of a plate; and a hook pivotally connected to the link.

13. The launch assembly of claim 12 wherein the hook is supported on the inboard ring of the housing, and the link is supported on the closed inboard end of the tube.

14. The launch assembly of claim 13 wherein the inboard end of the tube is closed by the plate which is constructed and arranged to provide support for the link.

15. The launch assembly of claim 12 further comprising a driver constructed and arranged to pivot the hook from engagement with the link in order to release the inboard end of the tube to launch the device.

16. The launch assembly of claim 15 wherein the driver is a piston.

17. The launch assembly of claim 10 wherein the drive assembly includes a motor operatively connected to the threaded rails to provide rotation of the threaded rails during use.

18. The launch assembly of claim 17 wherein the drive assembly further comprises:

a motor shaft joined to the motor; and a drive belt joined to the motor shaft and the threaded rails for operatively connecting the motor to the threaded rails.

19. A method of launching a device from an underwater vehicle comprising the steps of:

providing an elastomeric tube supported within a housing, the tube having a closed inboard end, an open outboard end, and constructed and dimensioned to receive an inboard end of the device to be launched;

moving the outboard end of the elastomeric tube along a length of the housing a predetermined distance while restraining the inboard end of the tube such that the inboard end of the tube remains substantially stationary and the tube becomes elongated;

stopping movement of the outboard end of the tube at the predetermined distance;

releasing the inboard end of the tube such that the inboard end travels toward the outboard end with a sufficient velocity to launch the device from within the tube at a desired speed.

* * * * *